US005624507A

United States Patent [19]

Halvorson

[11] Patent Number: 5,624,507

[45] Date of Patent: Apr. 29, 1997

[54] SYSTEM FOR PRODUCTION OF A QUENCHANT GAS MIXTURE

[75] Inventor: Thomas G. Halvorson, Lockport, N.Y.

[73] Assignee: Praxair Technology, Inc., Danbury, Conn.

[21] Appl. No.: 580,912

[22] Filed: Dec. 29, 1995

[51] Int. Cl.[6] ..... C21D 1/74

[52] U.S. Cl. ..... 65/434; 148/660; 148/663; 252/372

[58] Field of Search ..... 148/660, 663; 252/372; 65/434; 62/7

[56] References Cited

U.S. PATENT DOCUMENTS

| | | | |
|---|---|---|---|
| 4,643,401 | 2/1987 | Obman et al. | 266/80 |
| 5,157,957 | 10/1992 | Mettes et al. | 73/1 |
| 5,173,124 | 12/1992 | Baxter et al. | 148/633 |

OTHER PUBLICATIONS

R. Holoboff (Liquid Air Corp), et al. "Gas Quenching With Helium", Advanced Materials & Processes, Feb. 1993, pp. 23–26.

*Primary Examiner*—Sam Silverberg
*Attorney, Agent, or Firm*—Leisa M. Smith

[57] ABSTRACT

The invention provides a process and apparatus for producing a quench gas mixture for increasing the cooling rate of an article. The quench gas mixture is produced by introducing helium gas into the bottom of a vessel containing a cryogenic liquid. Heat is transferred directly from the helium gas to the cryogenic liquid as the helium bubbles rise through the liquid to the surface. The resulting cryogenic vapor mixes with the helium gas in the ullage space at the top of the vessel, and the gas mixture is taken off from the ullage space and supplied to a cooling process.

9 Claims, 3 Drawing Sheets

SYSTEM FOR PRODUCTION OF A QUENCHANT GAS MIXTURE

FIELD OF THE INVENTION

This invention relates to gas cooling or quenching of materials, and more particularly to the production of helium gas mixtures for quenching.

BACKGROUND OF THE INVENTION

In manufacturing processes which include a step for cooling materials, gas cooling or quenching of materials often is a rate limiting step. A quenching or cooling step in a process can be carried out on a batchwise or a continuous basis. An improvement in the cooling rate in the quenching step generally results in overall productivity improvement for the process.

Such improvements generally can be achieved in two ways: 1) increasing the heat transfer coefficient of the coolant, e.g. by increasing the fluid velocity of the coolant or changing the coolant's thermal properties, or 2) by increasing the temperature difference by lowering the temperature of the cooling fluid. Other limitations for gas quenching include the requirement that the quenchant or coolant gas and the cooling process must limit the heat removal rate to prevent damaging temperature gradients between the surface and the interior of the material being cooled. If temperature gradients develop, they may cause residual thermal strains or non-uniform material properties. In addition, the quenchant gas should not be chemically reactive with the material to avoid creation of undesirable compounds at the material surface which can alter the purity of the original composition of the material.

Both approaches for improving cooling rates, i.e. 1) increasing the heat transfer coefficient and 2) increasing the temperature difference, have been undertaken both independently and jointly. However, most attempts at improving the cooling rate have pursued one method or the other.

Improvement of the cooling rate by increasing the temperature difference may be accomplished by reducing the temperature of a quenchant gas. By employing a cryogenic heat exchanger, the temperature of the quenchant gas is lowered significantly below ambient temperature. Generally this is done by flowing the quenchant gas through a cooling coil immersed in a liquid nitrogen bath prior to the quenching step. This method pre-cools the quenchant gas only to a temperature approaching that of liquid nitrogen. Because of the temperature difference involved for indirect cooling, the quenchant gas would not be quite as cold as could be achieved if the gas were directly cooled in nitrogen.

One example of where both methods have been employed, (i.e. increasing the heat transfer coefficient and increasing the temperature difference), is in processes with vacuum furnace cooling systems. Both a recirculating blower and an external heat exchanger are used to reject the heat captured from a quenchant gas. Either water or air is the cooling fluid used in the heat exchangers and generally reduce the temperature of a quenchant gas only to ambient temperature. Cooling rates are sometimes improved by expensive modifications such as increasing the quench pressure or gas velocity.

The production of optical fibers requires cooling. The fibers are cooled to levels approaching ambient temperature before surface coatings can be applied. Various forms of helium gas systems are used for cooling which enable increased fiber draw speeds and production rates. However, most of the gas cooling systems are once-through flows without quenchant gas recirculation making the process more expensive.

Further, it is well known that helium has a high thermal conductivity and can be used to achieve faster rates of cooling. However, helium is more expensive than nitrogen or argon and thus, the use of pure helium as a quenchant gas is generally not cost effective. It is also known that cooling with mixtures of helium gas can result in improved heat transfer coefficients and therefore faster cooling. In some situations, helium mixtures may provide a higher cooling rate than 100% helium. One article discussing the characteristics of helium mixtures is *Gas Quenching With HELIUM,* Advanced Materials & Processes, February 1993.

U.S. Pat. No. 5,173,124 discloses the use of mixtures of helium and nitrogen or argon in specific ratios in turbulent flow conditions for improved cooling. Though this reference teaches achieving high cooling rates with the specified mixtures, it does not disclose how these mixtures are accomplished.

A variety of methods may be used to achieve the required mixtures of helium and a cryogen such as nitrogen or argon. U.S. Pat. No. 5,157,957 teaches a complex method for producing controlled gas mixtures which can be used in ultratrace level analysis. Mixing is carried out through a series of piping, valves, regulators and a mixing chamber. This system is sophisticated and costly as it produces very specific mixture compositions that are required to be highly accurate in quantities to be used as trace gas. Such a system would not be cost effective to produce mixtures in large bulk quantities.

OBJECTS OF THE INVENTION

It is therefore an object of the invention to provide a simple process and apparatus for producing a quenchant gas mixture with improved thermal transport properties and greater thermal driving force.

It is a further object of this invention to produce such a quenchant gas mixture without the need for complex control systems.

SUMMARY OF THE INVENTION

This invention comprises a method and apparatus for producing a quench gas mixture comprising helium and a cryogenic gas by bubbling helium gas through an inert cryogenic liquid. The helium gas is cooled as it rises through the cryogenic liquid which in turn is vaporized. The resulting cryogenic vapor and the helium gas which rise to the surface of the cryogenic liquid are mixed to form the mixture. The content of the mixture is controlled by the thermodynamic properties of the gaseous helium and the cryogenic liquid.

In a preferred embodiment, the gaseous helium is provided at ambient temperature, more preferably at about 70° F. and about 25 to 200 psia.

BRIEF DESCRIPTION OF THE DRAWINGS

Other objects, features and advantages will occur to those skilled in the art from the following description of preferred embodiments and the accompanying drawings, in which.

DETAILED DESCRIPTION OF THE INVENTION

In the practice of this invention gaseous helium is bubbled through a cryogenic liquid in an insulated vessel. Since a cryogenic liquid is a liquid at a temperature of −200° F. or colder, the gaseous helium transfers heat by direct contact with the cryogenic liquid and is thereby cooled. Such cryogenic liquids include liquid argon and liquid nitrogen or mixtures thereof. Inert cryogenic liquids are preferred to avoid reactivity of the gas mixture with the article to be cooled.

Simultaneously, the cryogenic liquid is warmed and vaporized. The vapor generation rate may be considerably higher than that which would occur naturally from environmental heat leak through the vessel's insulation. The vapor generated, when heat is transferred to the cryogenic liquid, collects at the top of the vessel in the ullage space above the liquid level.

Helium gas bubbles are cooled as they rise through the cryogenic liquid and emerge through the surface of the liquid to mix with the cryogen vapor in the ullage space. If there is sufficient residence time for the helium gas bubbles in the cryogenic liquid, the helium gas bubbles reach the surface of the liquid at about the same temperature of the cryogenic liquid. Thus both cooling of the helium gas and mixing with an inert gas takes place in one step in one vessel, without the use of complex controls.

The amount of heat transferred between the gaseous helium and the cryogenic liquid is directly related to their respective thermodynamic properties and is therefore self-limiting. This relationship offers the advantage that no major external controls (such as sophisticated pressure, temperature and flow control systems) are necessary for the required mixing to be achieved. The gas mixture composition is controlled by this self-limiting feature which determines the relative amounts of helium gas that rises to the top and the amount of cryogen vapor formed to produce a mixture. The mole fraction of helium gas in the final mixture is determined by the temperature of the gaseous helium introduced into the cryogenic liquid.

If the helium gas is heated prior to injection into the vessel, more heat may be transferred to the cryogenic liquid. More cryogenic vapor is generated resulting in a mixture that is richer in cryogenic vapor than would be the case if the helium gas is introduced into the cryogenic liquid at ambient temperature. Conversely, if the gaseous helium is precooled prior to injection, the heat transferred to the cryogenic liquid would be less, resulting in reduced cryogenic vapor generation and a gas mixture richer in helium.

Figure 1:
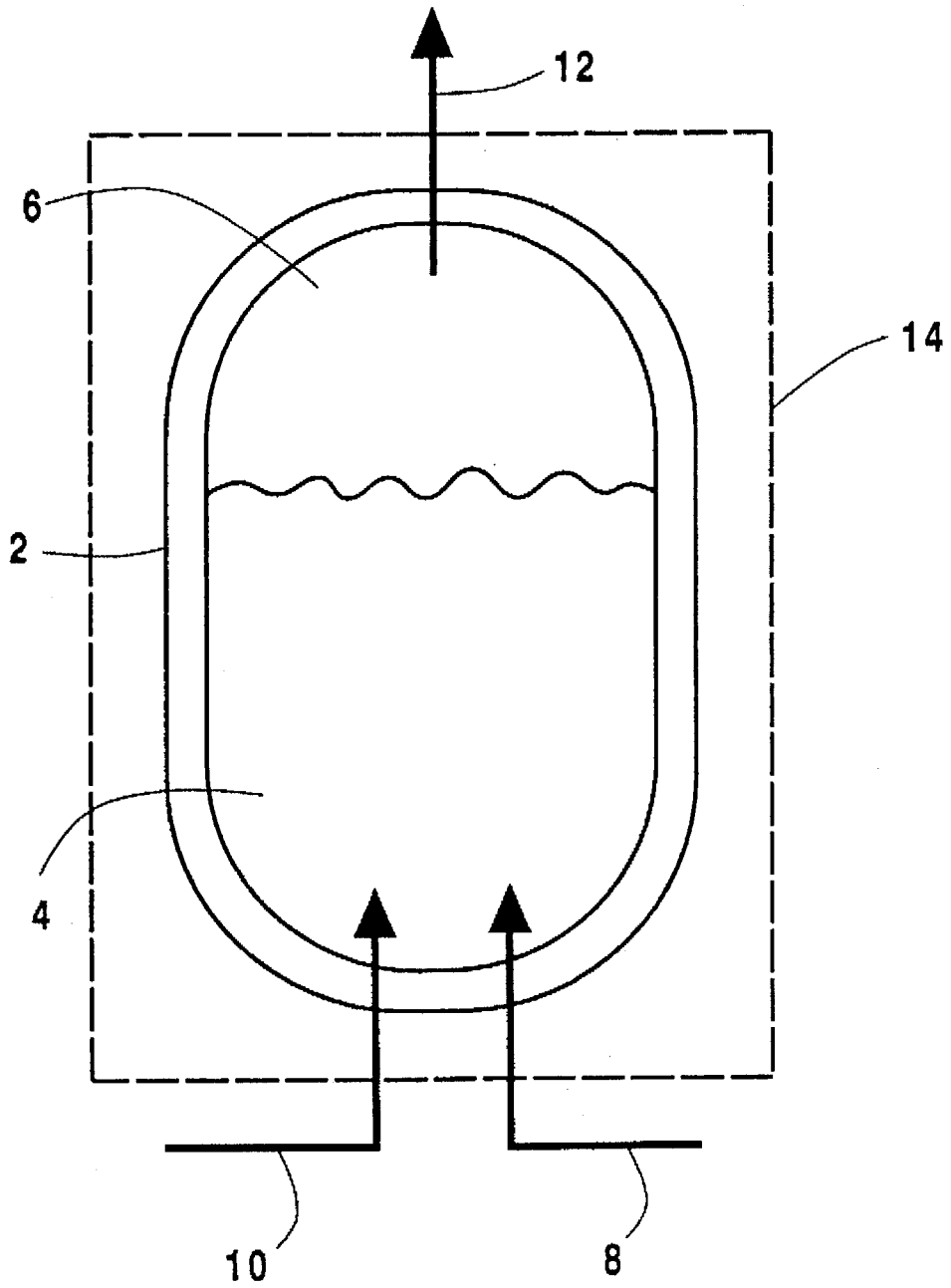
FIG. 1 is a schematic diagram of an embodiment of the invention wherein a cryogenic liquid and helium gas are introduced into a vessel and a helium-cryogen gas mixture is formed in the ullage space at the top of the vessel.

FIG. 1 shows an insulated pressure vessel 2, containing a cryogenic liquid 4 and having an ullage space 6 above the surface of the cryogenic liquid 4. Gaseous helium is provided into vessel 2 via conduit 8 while cryogenic liquid is provided into vessel 2 via conduit 10. The opening of conduit 8 is located substantially at or near the bottom of vessel 2. This is important to achieve maximum heat transfer, by allowing maximum residence time for the helium bubbles in the cryogenic liquid as the helium gas travels from the bottom to the surface of the cryogenic liquid. The gas mixture which accumulates in the ullage space is withdrawn from the vessel via conduit 12 and is passed to a cooling zone where it is used to cool an article such as optical fiber. Examples of other articles which may be cooled by the practice of this invention include metallic parts produced in vacuum furnaces.

If the pressure vessel 2 (of FIG. 1) containing a cryogenic liquid 4 and an ullage space 6 is taken as a control volume 14, then the gas mixture composition in the ullage space 6 can be calculated using an energy balance for steady flows across the control volume 14. One such equation is:

Heat In=Heat Out $$M_{He}\,H_{He1}+m_{N2}\,h_{LN2}=M_{He}\,H_{He2}+m_{N2}\,h_{GN2}$$

where, $M_{He}$=molar flow rate of helium $H_{He1}$=enthalpy of helium gas injected into vessel $m_{N2}$=molar flow rate of nitrogen $h_{LN2}$=enthalpy of liquid nitrogen entering vessel $H_{He2}$=enthalpy of helium gas in the mixture $h_{GN2}$=enthalpy of nitrogen gas in the mixture dividing both sides of the equation by the sum ($M_{He}+m_{N2}$) and defining the mole fraction of helium to be $X_{He}=M_{He}/(M_{He}+m_{N2})$, then the equation reduces to:

$$X_{He}\,H_{He1}+(1-X_{He})h_{LN2}=X_{He}\,H_{He2}+(1-X_{He})h_{GN2}$$

The equation can now be solved for $X_{He}$. An operating pressure is selected for the ullage space above the cryogenic liquid. The enthalpies on the right side of the equation ($H_{He2}$ and $h_{GN2}$) are determined based on the partial pressures of the mixture. $X_{He}$ is solved iteratively by first assuming a value for $X_{He}$ and then calculating the values on each side of the equation. By making subsequent adjustments in the "guess" for $X_{He}$, a value can be found which brings both sides into balance. This value for $X_{He}$ is unique for each operating pressure, P.

The helium mole fraction in mixtures with either nitrogen or argon is relatively insensitive to the operating pressure with just a slight increase noted with increasing pressure. The temperature of the helium gas being injected has a greater impact on the mole fraction of helium in the mixture than pressure. At a helium gas introduction temperature of 70° F., when the operating pressure is varied from 25 to 200 psia the mole fraction of helium ranges as follows:

| | 25 psia | 200 psia |
|---|---|---|
| Helium-Nitrogen | 0.55 | 0.58 |
| Helium-Argon | 0.59 | 0.62 |

Figure 2:
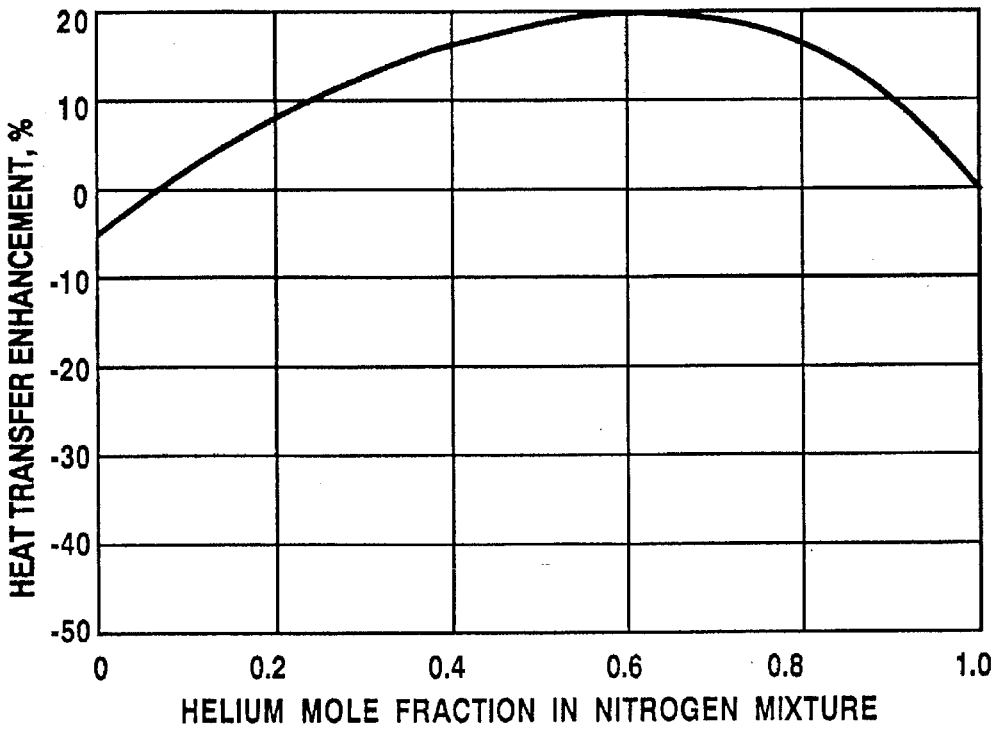
FIG. 2 is a graph illustrating the enhancement of the heat transfer coefficient of a helium-nitrogen mixture over the heat transfer coefficient of pure helium plotted against the mole fraction of helium in the helium-nitrogen mixture.

In FIG. 2 the curve demonstrates the enhancement of heat transfer properties of a helium-nitrogen mixture over the heat transfer properties of pure helium, expressed as a percentage. A broad peak is observed where a wide compositional range ($0.08<X_{He}<1.0$) shows heat transfer enhancement. The peak value is about 20% improvement at a helium mole fraction of about 65% ($X_{He}=0.65$) which is achieved when the helium gas is pre-cooled to −45° F.

A heat transfer enhancement effect is obtained over a broad helium gas temperature range (not shown in the figure) when nitrogen is the cryogenic liquid employed. The helium gas temperature can range from about −224° F. to about 369° F. to produce a mixture with a heat transfer enhancement that is greater than or equal to 16%. Pre-cooling to the colder temperatures in this range may not be necessary as ambient helium gas (at about 70° F.) can still produce a gas mixture with heat transfer enhancement of about 19%.

The embodiment of the invention illustrated in FIG. 1 enables the production of controlled mixture compositions that fall within the enhancement range of FIG. 2. Such a helium-nitrogen generator provides mixtures with helium mole fractions in the range of 55–59% when the helium gas is introduced at ambient temperatures (at about 70° F.). This range represents an enhancement factor of about 17% to about 19% which closely matches the enhancement peak of about 20% over pure helium.

Figure 3:
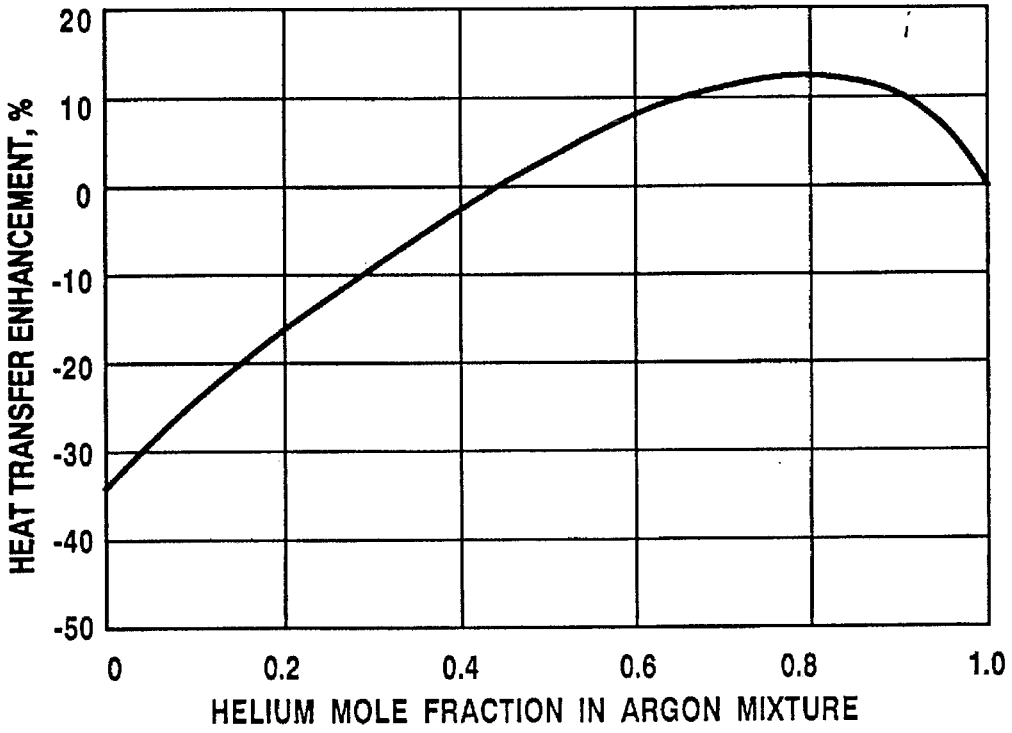
FIG. 3 is a similar illustration as in FIG. 2 for a helium-argon mixture.

Similarly, FIG. 3 shows the relationship for a helium-argon mixture. This curve has a tighter compositional range for enhancement over pure helium ($0.46<X_{He}<1.0$). A peak value of about 12% improvement is noted at a mole fraction of 80% ($X_{He}=0.80$) which is achieved when the helium gas is pre-cooled to about −148° F.

For helium-argon gas mixtures, the helium gas temperature can range from about −249° F. to about 2° F. to produce a gas mixture with heat transfer enhancement greater than or equal to about 10%. Though this range is somewhat colder than normal ambient temperature, helium gas at about ambient (70° F.) will produce a helium-argon gas mixture with heat transfer enhancement of about 8%.

A helium-argon generator of the invention, as shown in FIG. 1, provides mixtures with helium mole fractions in the range of 59–63%, with helium gas at ambient temperature of about 70° F. The helium mole fraction range achieved represents about 7% to about 9% enhancement, compared to a 12% peak enhancement.

Figure 4:
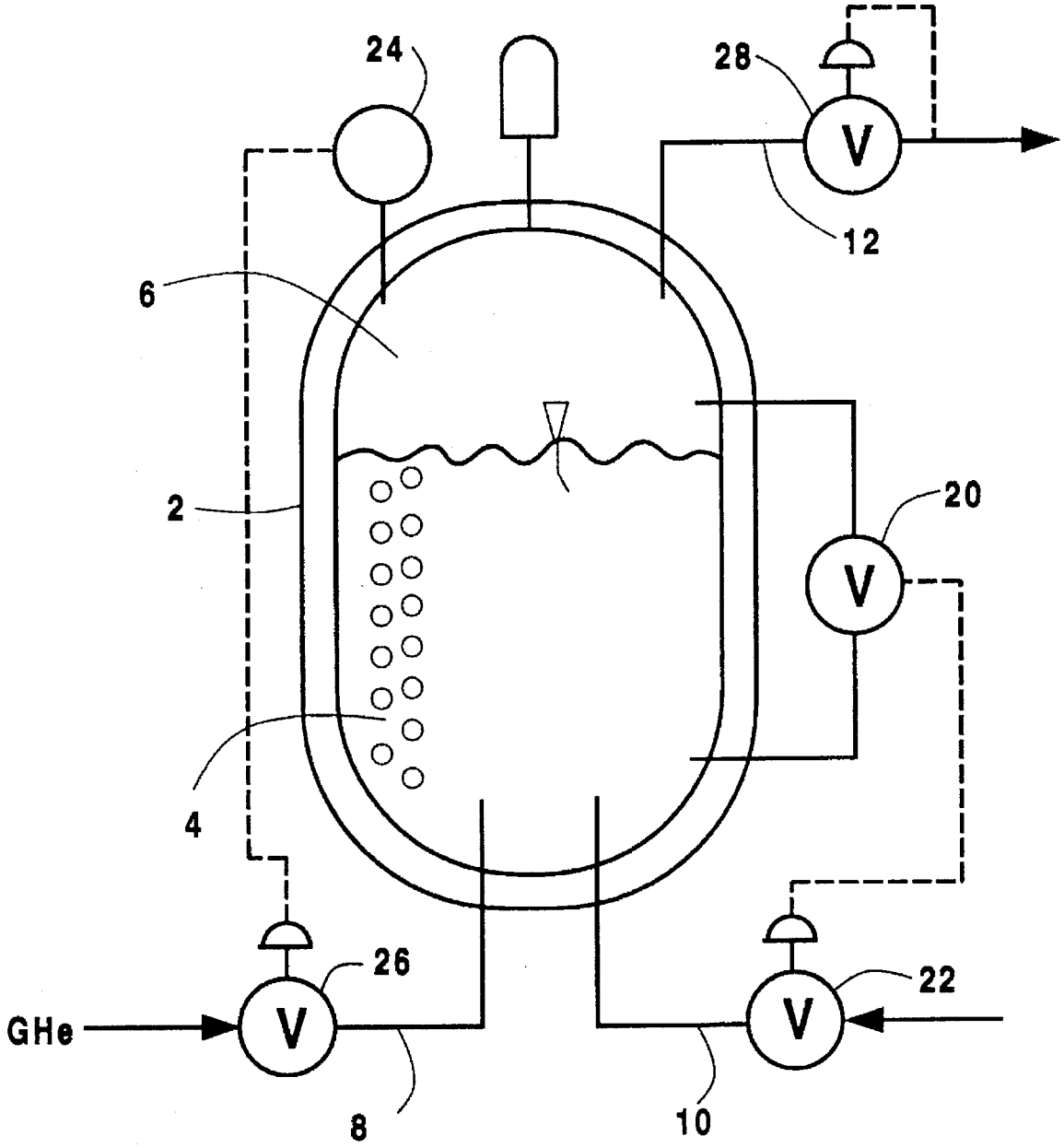
FIG. 4 is another schematic diagram of an embodiment of the invention utilizing simple controllers.

FIG. 4 shows some simple control features which could be used to facilitate operating the gas mixture generator of this invention on a continuous basis. The cryogenic liquid level within the vessel is maintained by using a level controller 20. The signal from level controller 20 is directed to control valve 22. The operating pressure within the vessel is controlled by a pressure controller 24 which has a signal directed to control valve 26. If a controlled gas mixture pressure is desired, a line pressure regulator 28 is used.

The enhancement effect for heat transfer using a helium mixture is best achieved in fully turbulent flows with Reynolds numbers greater than 40,000. However, helium-nitrogen mixtures produce some enhancement at Reynolds numbers greater than 4,000. At lower Reynolds numbers no enhancement peak is observed over the mixture compositional range.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A process for producing a quench gas mixture, comprising the steps of:

a) providing an insulated vessel having an ullage space and containing a cryogenic liquid;

b) injecting warm helium gas into the insulated vessel substantially at the bottom of the vessel, bubbling the helium gas through the cryogenic liquid and allowing the helium gas to collect in the ullage space;

c) vaporizing cryogenic liquid by direct heat exchange with helium gas as the helium gas bubbles through the cryogenic liquid to produce cryogenic vapor, and mixing cryogenic vapor with the helium gas in the ullage space to form a gas mixture comprising helium and cryogenic vapor; and d) withdrawing the gas mixture from the ullage space and passing the gas mixture to a cooling zone to cool an article.

2. The process of claim 1 wherein the cryogenic liquid is nitrogen.

3. The process of claim 2 wherein the gas mixture is passed to the cooling zone at a flow having a Reynolds number greater than 4,000.

4. The process of claim 2 wherein the gas mixture has a helium mole fraction of from about 55% to about 59%.

5. The process of claim 1 wherein the cryogenic liquid is argon.

6. The process of claim 5 wherein the mixture is passed to the cooling zone at a flow having a Reynolds number greater than 40,000.

7. The process of claim 5 wherein the gas mixture has a helium mole fraction of from about 59% to about 63%.

8. The process of claim 1 wherein the helium gas is at ambient temperature.

9. The process of claim 8 wherein the ambient temperature is about 70° F.

* * * * *